US012745860B2

(12) United States Patent
Zou

(10) Patent No.: US 12,745,860 B2
(45) Date of Patent: Sep. 29, 2026

(54) CRADLE MOVEMENT MECHANISM AND CRIB

(71) Applicant: Suzhou Lucky Intelligent Technology Co., Ltd., Kunshan (CN)

(72) Inventor: Xueming Zou, Kunshan (CN)

(73) Assignee: Suzhou Lucky Intelligent Technology Co., Ltd.

( * ) Notice: Subject to any disclaimer, the term of this patent is extended or adjusted under 35 U.S.C. 154(b) by 14 days.

(21) Appl. No.: 19/002,638

(22) Filed: Dec. 26, 2024

(65) Prior Publication Data

US 2026/0000220 A1 Jan. 1, 2026

(30) Foreign Application Priority Data

Jun. 27, 2024 (CN) ..... 202410841406.6

(51) Int. Cl.
*A47D 9/02* (2006.01)
*A47D 9/00* (2006.01)

(52) U.S. Cl.
CPC ..... *A47D 9/057* (2022.08); *A47D 9/008* (2022.08); *A47D 9/012* (2022.08)

(58) Field of Classification Search
CPC ..... A47D 9/057; A47D 9/008; A47D 9/012; A47D 7/005; A47D 9/02
See application file for complete search history.

(56) References Cited

U.S. PATENT DOCUMENTS 11,805,922 B1 * 11/2023 Shen ..... A47D 13/10
12,484,711 B1 * 12/2025 Bisgaard ..... A47D 9/012
2025/0040727 A1 * 2/2025 Yang ..... A47D 9/057

FOREIGN PATENT DOCUMENTS

CN 111760297 A * 10/2020 ..... A63G 1/00

OTHER PUBLICATIONS

CN 111760297 English Translation (Year: 2020).*

* cited by examiner

*Primary Examiner* — Aaron R Eastman

(57) ABSTRACT

A cradle movement mechanism and a crib are provided. The cradle movement mechanism comprises a vertical movement mechanism, a horizontal rotation mechanism and a mounting base, wherein the vertical movement mechanism comprises a first driving member, a lead screw and a nut; the first driving member drives the lead screw to rotate forward and backward, so that the nut moves up and down along the lead screw to drive the mounting base fixed on the nut to move up and down; the horizontal rotation mechanism comprises a second driving member and a main rotor; the main rotor is fixedly connected with the vertical movement mechanism, and when the second driving member drives the main rotor to rotate, the vertical movement mechanism and the mounting base are driven to do a horizontal circular movement.

9 Claims, 9 Drawing Sheets

CRADLE MOVEMENT MECHANISM AND CRIB

CROSS-REFERENCE TO RELATED APPLICATIONS

This application claims priority to Chinese Application No. 202410841406.6, having a filing date of Jun. 27, 2024, the entire contents of which are hereby incorporated by reference.

TECHNICAL FIELD

The present invention relates to a cradle movement mechanism and a crib and belongs to the technical field of cradles.

BACKGROUND OF THE INVENTION

A cradle typically refers to a bedding for a baby and is generally in the form of a crib or hammock, usually mounted on a swing or suspended from a pivot. It is comfortable for the baby to sleep in. An existing cradle which has a single swinging mode is not effective to lull the baby. In addition, the existing cradle is mostly designed integrally and its application occasions are limited.

The information disclosed in the background is intended only to better understand the general background of the invention and should not be taken as an admission or in any way an implication that the information constitutes prior art which is already known to a person of ordinary skill in the art.

SUMMARY OF THE INVENTION

The present invention is intended to overcome the shortcomings of the prior art and provide a cradle movement mechanism and a crib. The cradle movement mechanism can produce vertical motion and/or horizontal circular motion, thereby bringing various experiences to the baby. When installed in the crib of the present application, the cradle movement mechanism can achieve the same effect. In addition, the crib of the present invention is designed to be multi-functional and detachable, and the overall height of the crib can be increased so that family members can take care of the baby conveniently.

In order to achieve the above purpose, the present invention is implemented by the following technical solution:

In a first aspect, the present invention provides a cradle movement mechanism, comprising a vertical movement mechanism, a horizontal rotation mechanism and a mounting base, wherein the vertical movement mechanism comprises a first driving member, a lead screw and a nut, the first driving member drives the lead screw to rotate forward and backward, so that the nut moves up and down along the lead screw to drive the mounting base fixed on the nut to move up and down;

the horizontal rotation mechanism comprises a second driving member and a main rotor; the main rotor is fixedly connected with the vertical movement mechanism, and when the second driving member drives the main rotor to rotate, the vertical movement mechanism and the mounting base are driven to do a horizontal circular movement.

Further, the vertical movement mechanism further comprises a platform; an assembly hole is formed at the center of the platform; a fixed end of the lead screw passes through the assembly hole and is fixedly connected with the first driving member; the lead screw and the assembly hole are connected rotatably by a first bearing.

Further, the platform is provided with guide posts; the mounting base is provided with guide grooves; when the mounting base moves up and down, the guide grooves move up and down along the guide posts.

Further, an outer side of each guide groove is connected with a pulley; when the guide grooves move up and down along the guide posts, the pulleys are capable of rotating against the guide posts.

Further, the first driving member comprises a first motor, a first driving belt pulley, a first driven belt pulley and a first reducer box; the first driving belt pulley and the first driven belt pulley are in transmission connection by a belt; the first driving belt pulley is connected with the first motor by the first reducer box; the first driven belt pulley is fixedly connected with the lead screw; the first motor drives the first reducer box to rotate the first driving belt pulley, so that the first driven belt pulley drives the lead screw to rotate.

Further, the horizontal rotation mechanism comprises auxiliary rotors; the auxiliary rotors are fixedly connected with the vertical movement mechanism and are configured to assist the vertical movement mechanism and the mounting base to do a horizontal circular movement.

Further, the main rotor is formed integrally, and comprises a rotating post, a connecting block and an unthreaded shaft; the connecting block is arranged vertically at an upper end of the rotating post; the unthreaded shaft is arranged vertically above the connecting block and parallel to the rotating post; the unthreaded shaft is fixedly connected with the vertical movement mechanism; the auxiliary rotors have the same structure as the main rotor.

Further, the horizontal rotation mechanism further comprises a bottom plate; the bottom plate is provided with a plurality of rotor cavities; the centers of the rotor cavities are on a same circle; the main rotor and the auxiliary rotors are correspondingly connected in the rotor cavities rotatably; the second driving member is arranged on the bottom plate;

the second driving member comprises a second motor, a second driving belt pulley, a second driven belt pulley and a second reducer box; the second driven belt pulley is fixedly connected with the rotating post of the main rotor; the second motor drives the second reducer box to rotate the second driving belt pulley; by a belt, the second driving belt pulley drives the second driven belt pulley and the main rotor to rotate.

In a second aspect, the present invention provides a crib, comprising a lower cover, an upper cover, a crib frame and the cradle movement mechanism described above; the bottom of the lower cover is detachably connected with a plurality of legs; the bottom of the crib frame is detachably connected with a bed plate support; the upper cover is provided with a mounting slot;

the mounting base, the vertical movement mechanism and the horizontal rotation mechanism are assembled and arranged in the lower cover; the upper cover is mated above the lower cover, and a part of the mounting base extends out of the mounting slot and is detachably connected with the bed plate support.

Further, the crib further comprises a safety stopper; the safety stopper comprises a fixing base and a baffle plate which are formed integrally; the baffle plate is arranged at the periphery of the fixing base; the fixing base is sleeved above the mounting base, and the baffle plate is arranged below the mounting slot; when the horizontal rotation mechanism drives the vertical movement mechanism and the mounting base to do a horizontal circular movement, the baffle plate also rotates accordingly and always shields the mounting slot.

Compared with the prior art, the invention achieves the following beneficial effects:

The invention provides a cradle movement mechanism. The vertical movement mechanism in the cradle movement mechanism controls the lead screw to rotate forward and backward by means of the first driving member, so that the nut moves up and down along the lead screw, thus driving the mounting base to move up and down. The mounting base is configured to fix and mount a cradle for a baby, so that the cradle rises and falls; the main rotating member of the main rotor in the horizontal rotation mechanism is fixedly connected with the vertical movement mechanism. When the second driving member drives the main rotor to rotate, the main rotating member is driven to do a horizontal circular movement and then the vertical movement mechanism and the cradle mounted on the fixing base also do the horizontal circular movement accordingly. The use of the vertical movement and/or horizontal circular movement provides various lulling experiences for babies.

The present invention further provides a crib which is internally provided with a cradle movement mechanism of the present application, and has the same use effect. In addition, the leg design of the crib can increase the height of the crib and improve the convenience and comfort of taking care of the baby. The crib of the present application is designed to be detachable, and the crib frame is detachable to carry and use, providing many use modes. In this way, the crib can be used in many occasions.

Figure 1:
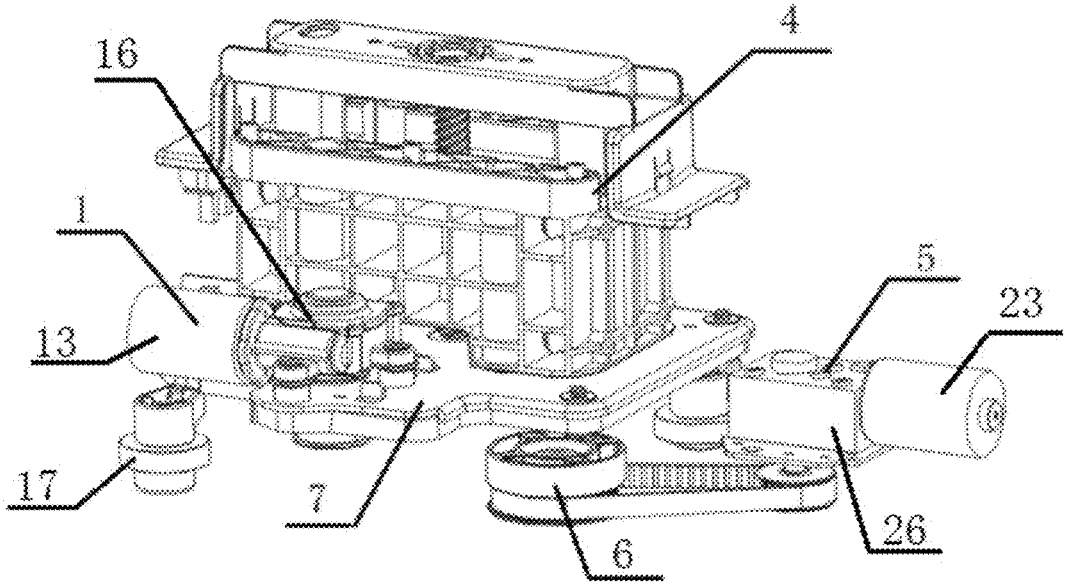
FIG. 1 is a schematic structural diagram of a cradle movement mechanism according to the present invention.

In the figures: 1. first driving member; 2. lead screw; 3. nut; 4. mounting base; 5. second driving member; 6. main rotor; 7. platform; 8. assembly hole; 9. first bearing; 10. guide post; 11. guide groove; 12, pulley; 13. first motor; 14. first driving belt pulley; 15. first driven belt pulley; 16. first reducer box; 17. auxiliary rotor; 18. rotating post; 19. connecting block; 20. unthreaded shaft; 21. bottom plate; 22. rotor cavity; 23. second motor; 24. second driving belt pulley; 25. second driven belt pulley; 26. second reducer box; 27. second bearing; 28. crib; 29. lower cover; 30. upper cover; 31, crib frame; 32. leg; 33, bed plate support; 34. mounting slot; 35. safety stopper; 36. fixing base; 37. baffle plate.

DETAILED DESCRIPTION OF THE INVENTION

The invention is further described below in conjunction with the accompanying drawings. The following embodiments are only used to more clearly illustrate the technical solution of the invention, and cannot be construed as limiting the scope of the invention.

Embodiment 1

Referring to FIGS. 1-6, this embodiment provides a cradle movement mechanism, comprising a vertical movement mechanism, a horizontal rotation mechanism and a mounting base 4. The mounting base 4 is configured to fix a cradle for a baby. The vertical movement mechanism comprises a first driving member 1, a lead screw 2 and a nut 3. The nut 3 and the lead screw 2 are in threaded connection, and the nut 3 is fixedly connected with the mounting base 4. The first driving member 1 drives the lead screw 2 to rotate forward and backward, and the nut 3 on the lead screw 2 moves up and down along a thread of the lead screw 2 to drive the mounting base 4 to move up and down, and then the cradle on the mounting base 4 rises and falls accordingly.

The horizontal rotation mechanism comprises a second driving member 5 and a main rotor 6. The main rotor 6 is fixedly connected with the vertical movement mechanism. When the second driving member 5 drives the main rotor 6 to rotate, the vertical movement mechanism connected with the main rotor 6 and the mounting base 4 are driven to do horizontal circular movement accordingly.

Figure 2:
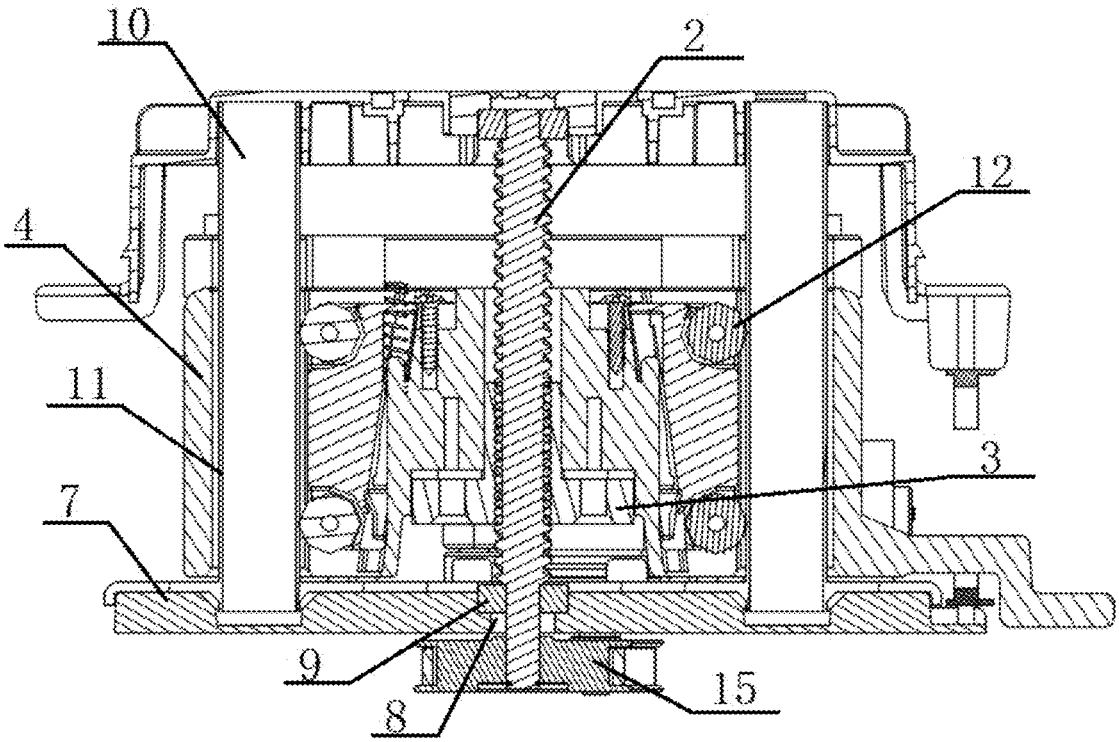
FIG. 2 is a partial cross-section diagram of FIG. 1.
Figure 4:
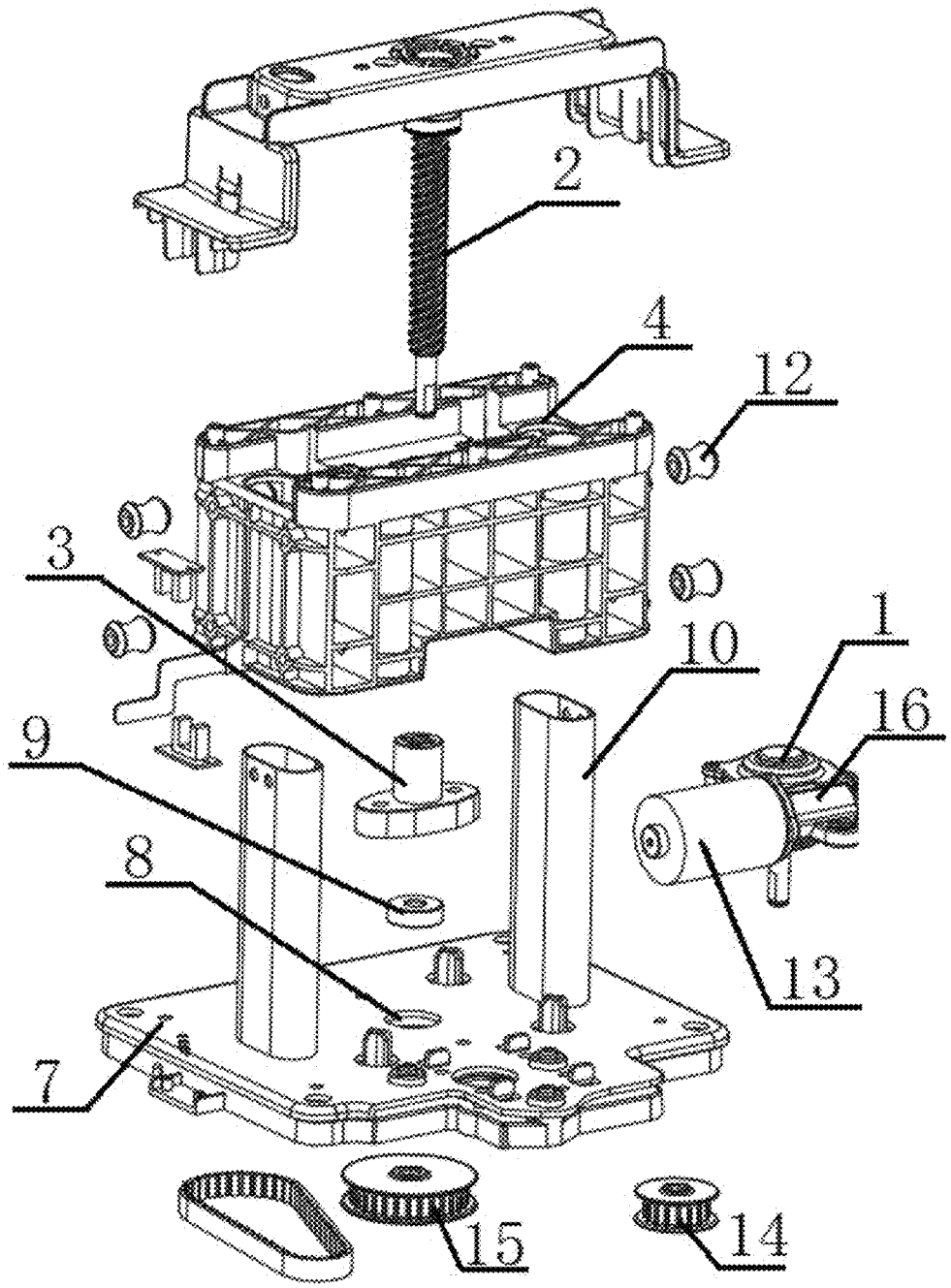
FIG. 4 is a split structural diagram of a vertical movement mechanism and a mounting base in FIG. 1.

Optionally, as shown in FIGS. 1, 2 and 4, the vertical movement mechanism comprises a platform 7, and an assembly hole 8 is formed at the center of the platform 7. During installation, a fixed end of the lead screw 2 passes through the assembly hole 8 and is fixedly connected with the first driving member 1. The lead screw 2 and the assembly hole 8 are connected rotatably by a first bearing 9.

Specifically, the platform 7 is provided with guide posts 10 and correspondingly the mounting base 4 is provided with guide grooves 11. When the mounting base 4 moves up and down, the guide grooves 11 move up and down along the guide posts 10, so that the cradle mounted on the mounting base 4 can accurately rise and fall without tilting or moving in other directions, thereby providing a better comfort effect.

An outer side of each guide groove 11 is connected with a pulley 12 and outer surfaces of the pulleys 12 are flush with side walls of guide grooves 11. When the guide grooves 11 move up and down along the guide posts 10, the pulleys 12 rotate against the guide posts 10, thereby reducing friction, improving the smoothness of the vertical movement, and prolonging the overall service life of the cradle movement mechanism.

Figure 3:
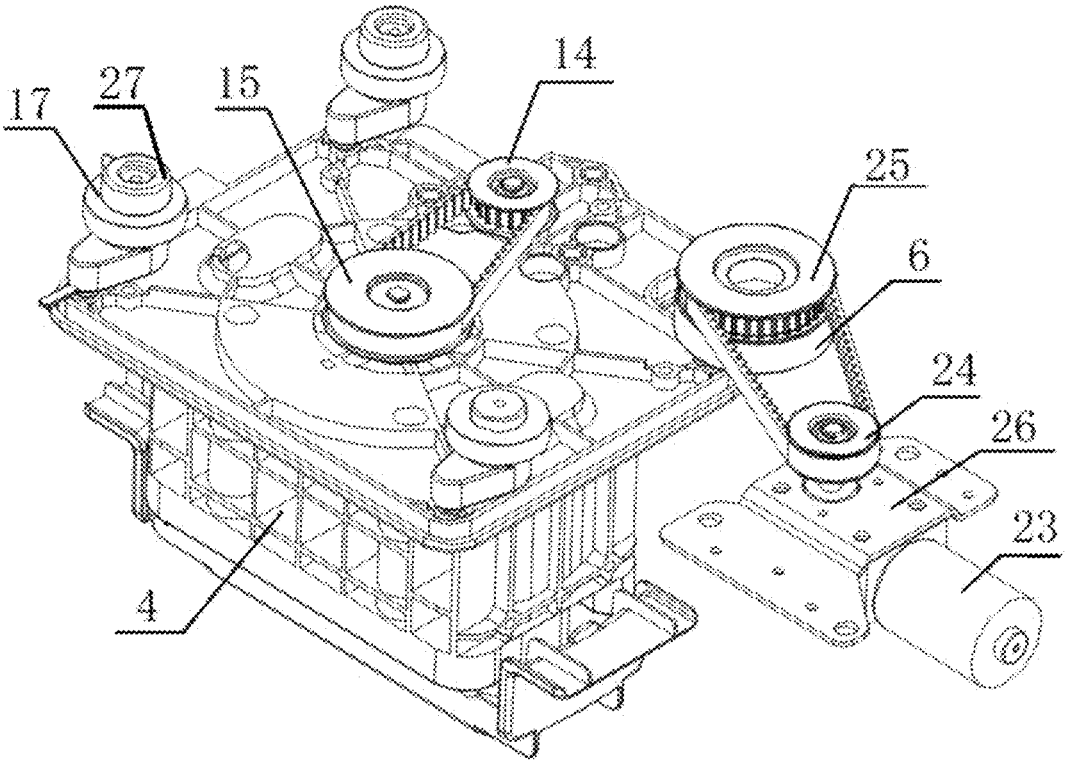
FIG. 3 is a schematic structural diagram of FIG. 1 viewed from one angle.

Optionally, referring to FIGS. 1, 3 and 4, the first driving member 1 is arranged on the platform 7, and the first driving member 1 comprises a first motor 13, a first driving belt pulley 14, a first driven belt pulley 15 and a first reducer box 16. The first driving belt pulley 14 and the first driven belt pulley 15 are in transmission connection by a belt. The first motor 13 is provided with the first reducer box 16. The first reducer box 16 is connected with the first driving belt pulley 14 and configured to drive the first driving belt pulley 14 to rotate. The first driven belt pulley 15 is fixedly connected with the lead screw 2 and configured to drive the lead screw 2 to rotate. The first motor 13 drives the first reducer box 16 to rotate the first driving belt pulley, and the first driven belt pulley 15 then rotates by means of the belt. When the first driven belt pulley 15 rotates, the lead screw 2 is driven to rotate. Specifically, the lead screw 2 is fixed at the center of the first driven belt pulley 15. Installation position: the first motor 13 and the first reducer box 16 are assembled and then mounted above the platform 7, and a shaft of the first reducer box 16 is fixedly connected with the first driving belt pulley 14 under the platform 7 by the platform 7.

Figure 6:
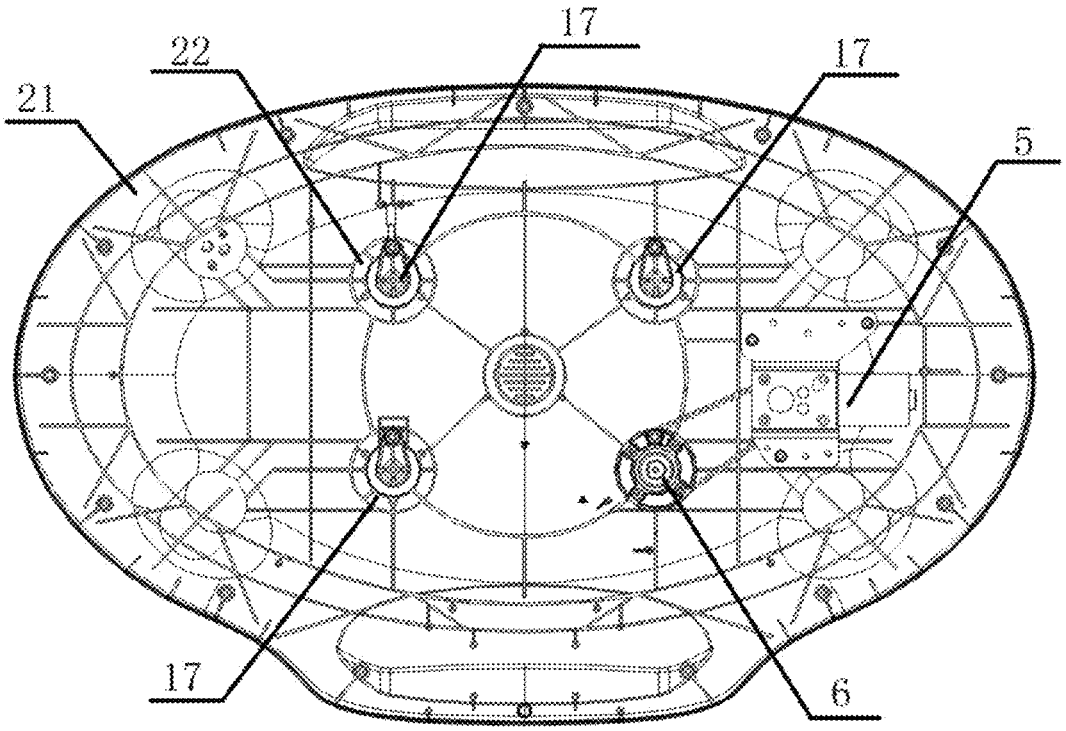
FIG. 6 is a schematic structural diagram of the main rotor and the auxiliary rotors which are assembled in a bottom plate.

Optionally, referring to FIG. 6, the horizontal rotation mechanism comprises auxiliary rotors 17; the auxiliary rotors 17 are fixedly connected with the vertical movement mechanism and configured to assist the vertical movement mechanism and the mounting base 4 to do a horizontal circular movement.

Figure 5:
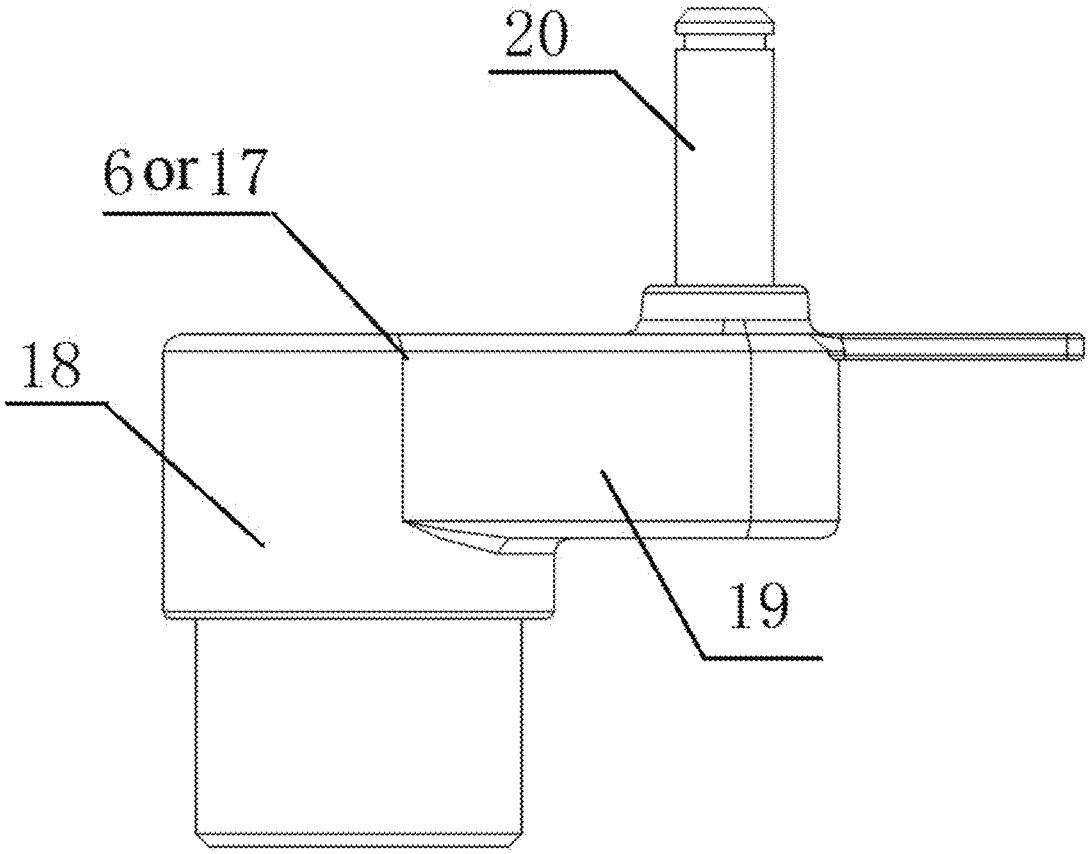
FIG. 5 is a schematic structural diagram of a main rotor or an auxiliary rotor.

Specifically, as shown in FIG. 5, the main rotor 6 of this embodiment is formed integrally, and the main rotor 6 comprises a rotating post 18, a connecting block 19 and an unthreaded shaft 20. The connecting block 19 is arranged vertically at an upper end of the rotating post 18, and the unthreaded shaft 20 is arranged vertically above the connecting block 19. The mounted unthreaded shaft 20 and the rotating post 18 are parallel to each other. The unthreaded shaft 20 is fixedly connected with the vertical movement mechanism. In this embodiment, the platform 7 is provided with a mounting hole at the bottom, and after the unthreaded shaft 20 is inserted into the mounting hole, a screw is fixed near the mounting hole, so that the head of the screw limits the unthreaded shaft 20. The auxiliary rotors 17 have the same structure as the main rotor 6, and it will not be detailed again here.

Optionally, as shown in FIG. 6, the horizontal rotation mechanism further comprises a bottom plate 21, the bottom plate 21 is provided with a plurality of rotor cavities 22, and the centers of the rotor cavities are on a same circle. In this embodiment, four rotor cavities 22 are provided, three of the rotor cavities 22 are respectively connected with the auxiliary rotors 17 rotatably, and the other one rotor cavity 22 is configured to be connected with the main rotor 6 rotatably. In this embodiment, second bearings 27 are arranged on the rotating posts 18 of the main rotor 6 and the auxiliary rotors 17 respectively, and the second bearings 27 are mounted in the corresponding rotor cavities 22 to achieve the corresponding rotating connection. The second driving member 5 is mounted on the bottom plate 21.

Referring to FIGS. 3, 5 and 6, the second driving member 5 comprises a second motor 23, a second driving belt pulley 24, a second driven belt pulley 25 and a second reducer box 26. The core of the second driven belt pulley 25 is fixedly connected with the rotating post 18 of the main rotor 6. The second motor 23 is fixedly connected with the second reducer box 26, and the shaft of the second reducer box 26 is driven to rotate the second driving belt pulley 24. By a belt, the second driving belt pulley 24 drives the second driven belt pulley 25 to rotate, thereby driving the main rotor 6 to rotate.

The first motor 13 and the second motor 23 used in this embodiment are brushless motors. In this embodiment, the cradle movement mechanism further comprises a controller, a first sensor and a second sensor. The controller is electrically connected to the first sensor, the second sensor, the first motor 13 and the second motor 23 respectively. The first sensor is mounted on platform 7. Correspondingly, the second sensor is mounted on the mounting base 4. The baffle plate is arranged in the middle position of a shooting point of the first sensor. The first sensor transmits monitored line feedback information to the controller, and the controller drives the first motor 13 to rotate backward, thereby driving the mounting base 4 to do reverse upward movement. When the baffle plate rises to the middle position of a shooting point of the second sensor, the second sensor transmits monitored line feedback information to the controller, and then the first motor 13 is driven to rotate backward, drives the mounting base 4, thereby driving the mounting base 4 to do reverse downward movement. Then, another round of operations starts over and over again.

In the present application, a reflective photoelectric sensor is mounted on the bottom plate 21, and a position sensing bar is provided on the main rotor 6. The reflective photoelectric sensor can read the rotation of the first driven belt pulley 15. When the position sensor passes the reflective photoelectric sensor, the reflective photoelectric sensor obtains a reflected signal to determine the specific position of the first driven belt pulley 15 to control the movement positioning.

Embodiment 2

Figure 7:
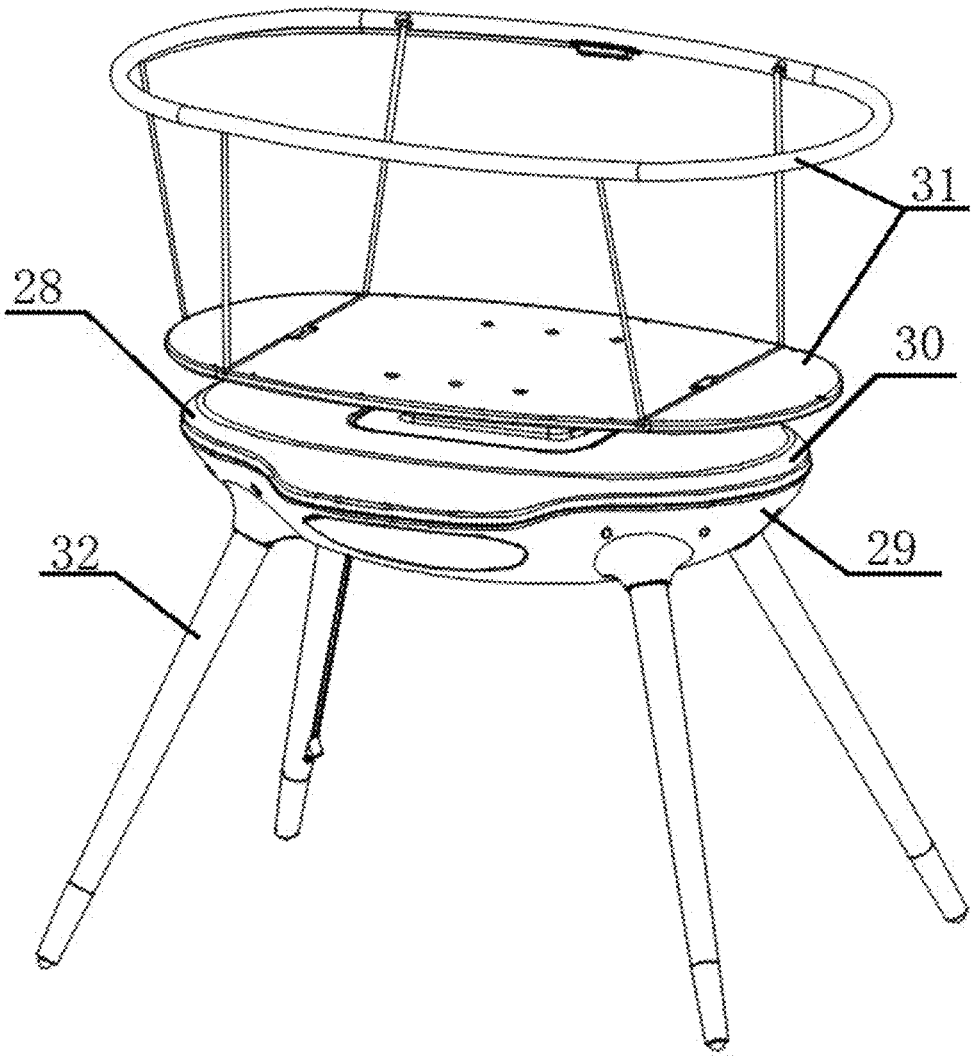
FIG. 7 is a schematic structural diagram of a crib according to the present invention.
Figure 8:
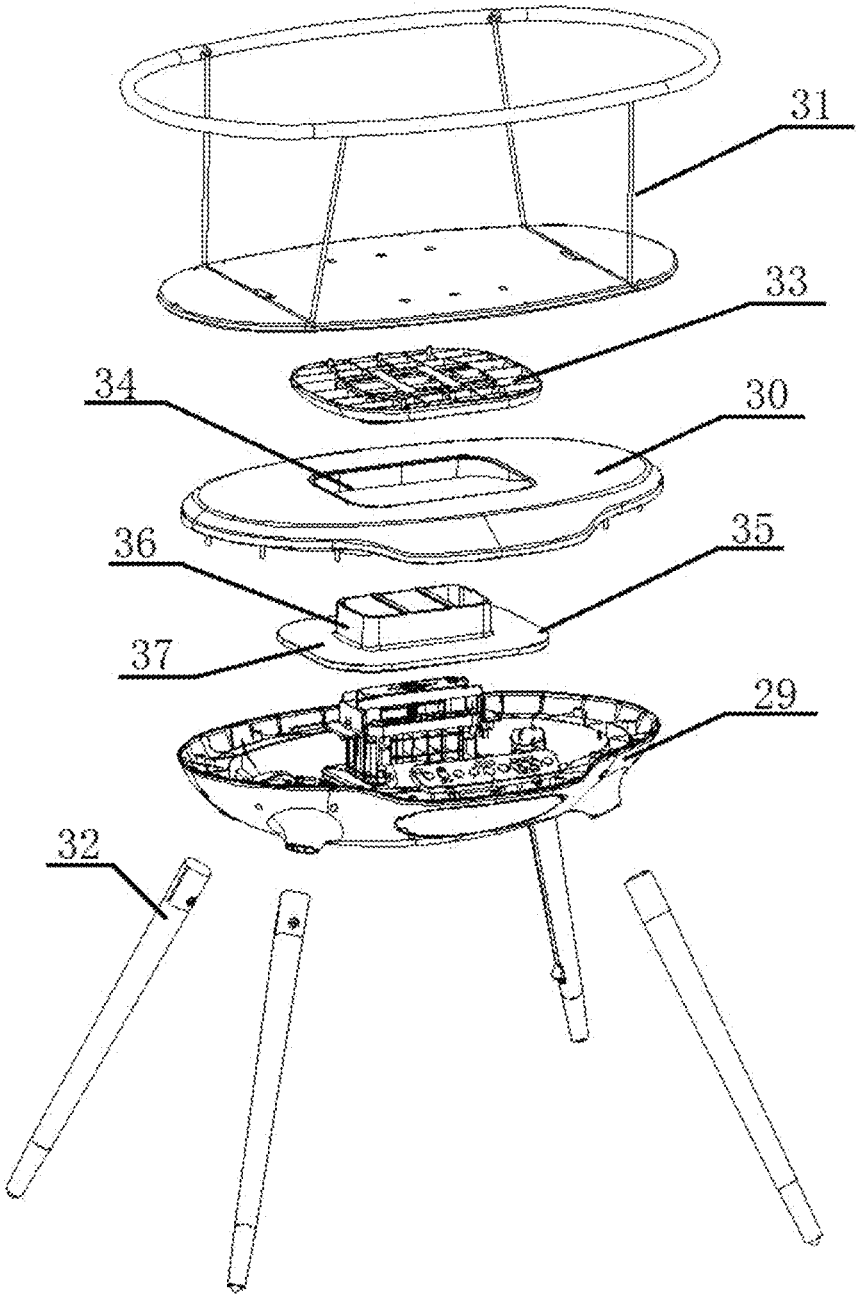
FIG. 8 is a split diagram of the crib equipped with a cradle movement mechanism.
Figure 9:
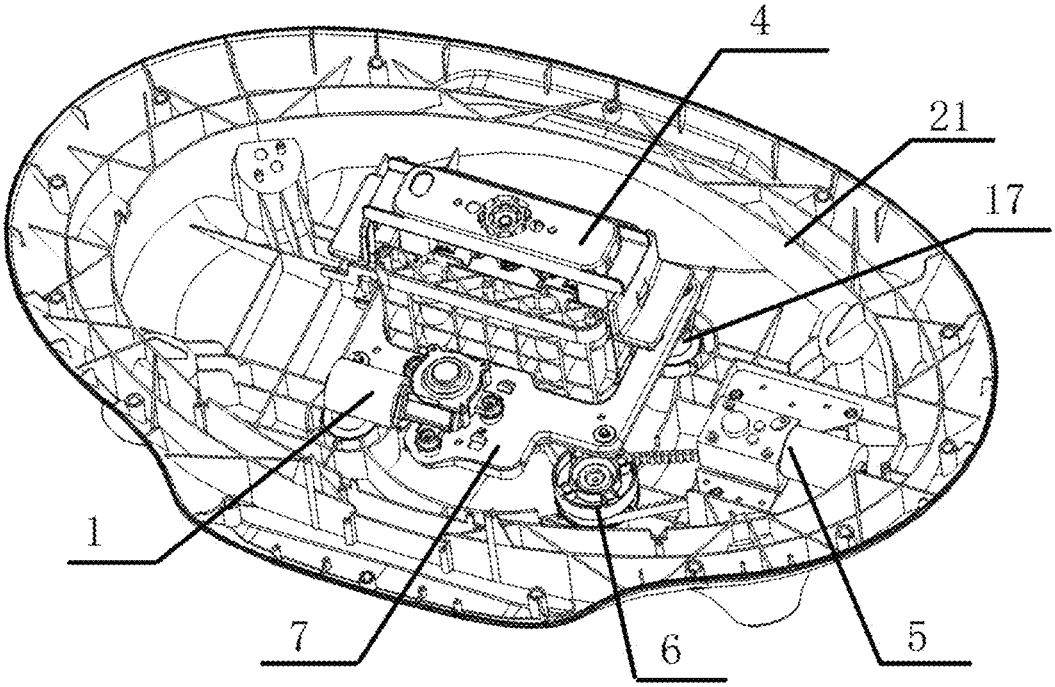
FIG. 9 is an installation diagram of a lower cover equipped with the cradle movement mechanism.

Referring to Embodiment 1 and FIGS. 7 to 9, the present embodiment provides a crib 28 comprising a lower cover 29, an upper cover 30, a crib frame 31, and the cradle movement mechanisms according to any one of technical solutions described in Embodiment 1. The bottom of the lower cover 29 is detachably connected with a plurality of legs 32. Specifically, this embodiment uses four legs 32 mounted at the bottom of the lower cover 29. A bed plate support 33 is detachably connected with the bottom of the crib frame 31. The upper cover 30 is provided with a mounting slot 34.

During installation, as shown in FIG. 9, the mounting base 4, the vertical movement mechanism and the horizontal rotation mechanism are assembled and connected and then jointly installed in the lower cover 29. Specifically, the bottom plate 21 provided in Embodiment 1 may be fixed and mounted in the lower cover 29. The upper cover 30 is mated above the lower cover 29 to wrap the cradle movement mechanism. In the meanwhile, a part of the mounting base 4 extends out of the mounting slot 34 and is detachably connected with the bed plate support 33. In this way, the crib frame 31 can be controlled by the cradle movement mechanism to move.

The crib 28 of the present application can provide many ways for lulling a baby, and also facilitate the multifunctional use of the crib 28 by parents. When users need to carry a bedding for a baby, it is not necessary to buy a portable bed, the crib frame 31 can be directly detached separately, and easily carried in and out of public places.

As shown in FIG. 8, the crib 28 further comprises a safety stopper 35; the safety stopper 35 comprises a fixing base 36 and a baffle plate 37 which are formed integrally. The baffle plate 37 is arranged at the periphery of the fixing base 36. The fixing base 36 is sleeved and connected above the mounting base 4, and the baffle plate 37 is arranged below the mounting slot 34 to shield the mounting slot 34. The design shall meet that when the horizontal rotation mechanism drives the vertical movement mechanism and the mounting base 4 to do a horizontal circular movement, the baffle plate 37 also rotates accordingly and always shields the mounting slot 34. The shield design can avoid pinching damage to people or objects due to the large gap in the mounting slot 34 when the cradle movement mechanism works, thereby improving the use safety of the crib 28.

In the description of the invention, it should be understood that the orientation or position relationships indicated by the terms "center", "longitudinal", "transverse", "up", "down", "front", "back", "left", "right", "vertical", "horizontal", "top", "bottom", "inside", "outside", etc., are based on the orientation or position relationships shown in the accompanying drawings and are used only for the convenience of describing the invention and simplifying the description, rather than indicating or implying that the device or element referred to must have a specific orientation, be constructed and operated in a specific orientation. Therefore, they should not be understood as limiting the invention. In addition, the terms "first", "second", etc., are used for descriptive purposes only and are not to be understood as indicating or implying relative importance or as implicitly indicating the quantity of technical features indicated. Therefore, the features defined as "first" and "second" may explicitly or implicitly include one or more of the features. In the description of the invention, "a plurality of" means two or more unless otherwise stated.

In the description of the invention, it should be noted that, unless otherwise expressly specified and limited, the terms "mount", "connected with" and "connect" shall be understood broadly, for example, they may refer to fixed connection, detachable connection, or integrated connection; they may refer to mechanical connection or electrical connection; they may refer to direct connection, or indirect connection by an intermediate medium, or connection within two components. For those of ordinary skill in the art, the specific meanings of the above terms in the invention can be understood according to specific circumstances.

The above is only preferred embodiments of the present invention. It should be pointed out that for those of ordinary skill in the art, several improvements and modifications can be made without departing from the technical principles of the present invention. These improvements and modifications should also be regarded as the scope of the present invention.

The invention claimed is:

1. A cradle movement mechanism, comprising a vertical movement mechanism, a horizontal rotation mechanism and a mounting base, wherein the vertical movement mechanism comprises a first driving member, a lead screw and a nut, the first driving member drives the lead screw to rotate forward and backward, so that the nut moves up and down along the lead screw to drive the mounting base fixed on the nut to move up and down;

the horizontal rotation mechanism comprises a second driving member and a main rotor; the main rotor is fixedly connected with the vertical movement mechanism, and when the second driving member drives the main rotor to rotate, the vertical movement mechanism and the mounting base are driven to do a horizontal circular movement;

wherein the first driving member comprises a first motor, a first driving belt pulley, a first driven belt pulley and a first reducer box; the first driving belt pulley and the first driven belt pulley are in transmission connection by a belt; the first driving belt pulley is connected with the first motor by the first reducer box; the first driven belt pulley is fixedly connected with the lead screw; the first motor drives the first reducer box to rotate the first driving belt pulley, so that the first driven belt pulley drives the lead screw to rotate.

2. The cradle movement mechanism according to claim 1, wherein the vertical movement mechanism further comprises a platform; an assembly hole is formed at the center of the platform; a fixed end of the lead screw passes through the assembly hole and is fixedly connected with the first driving member.

3. The cradle movement mechanism according to claim 2, wherein the platform is provided with guide posts; the mounting base is provided with guide grooves; when the mounting base moves up and down, the guide grooves move up and down along the guide posts.

4. The cradle movement mechanism according to claim 3, wherein an outer side of each guide groove is connected with a pulley; when the guide grooves move up and down along the guide posts, the pulleys are capable of rotating against the guide posts.

5. The cradle movement mechanism according to claim 1, wherein the horizontal rotation mechanism comprises auxiliary rotors; the auxiliary rotors are fixedly connected with the vertical movement mechanism and are configured to assist the vertical movement mechanism and the mounting base to do a horizontal circular movement.

6. The cradle movement mechanism according to claim 5, wherein the main rotor formed integrally comprises a rotating post, a connecting block and an unthreaded shaft; the connecting block is arranged vertically at an upper end of the rotating post; the unthreaded shaft is arranged vertically above the connecting block and parallel to the rotating post; the unthreaded shaft is fixedly connected with the vertical movement mechanism; the auxiliary rotors have the same structure as the main rotor.

7. The cradle movement mechanism according to claim 6, wherein the horizontal rotation mechanism further comprises a bottom plate; the bottom plate is provided with a plurality of rotor cavities; the centers of the rotor cavities are on a same circle; the main rotor and the auxiliary rotors are correspondingly connected in the rotor cavities rotatably; the second driving member is arranged on the bottom plate;

the second driving member comprises a second motor, a second driving belt pulley, a second driven belt pulley and a second reducer box; the second driven belt pulley is fixedly connected with the rotating post of the main rotor; the second motor drives the second reducer box to rotate the second driving belt pulley; by a belt, the second driving belt pulley drives the second driven belt pulley and the main rotor to rotate.

8. A crib, comprising a lower cover, an upper cover, a crib frame and the cradle movement mechanism according to claim 1; the bottom of the lower cover is detachably connected with a plurality of legs; the bottom of the crib frame is detachably connected with a bed plate support; the upper cover is provided with a mounting slot;

the mounting base, the vertical movement mechanism and the horizontal rotation mechanism are assembled and arranged in the lower cover; the upper cover is mated above the lower cover, and a part of the mounting base extends out of the mounting slot and is detachably connected with the bed plate support.

9. The crib according to claim 8, further comprising a safety stopper, wherein the safety stopper comprises a fixing base and a baffle plate which are formed integrally; the baffle plate is arranged at the periphery of the fixing base; the fixing base is sleeved above the mounting base, and the baffle plate is arranged below the mounting slot; when the horizontal rotation mechanism drives the vertical movement mechanism and the mounting base to do a horizontal circular movement, the baffle plate also rotates accordingly and always shields the mounting slot.

* * * * *